US006584910B1

(12) United States Patent
Plass

(10) Patent No.: US 6,584,910 B1
(45) Date of Patent: Jul. 1, 2003

(54) ANIMAL SYRINGE SYSTEM

(76) Inventor: David J. Plass, 1060 Cherry Ave., Bird Island, MN (US) 55310

( * ) Notice: Subject to any disclaimer, the term of this patent is extended or adjusted under 35 U.S.C. 154(b) by 0 days.

(21) Appl. No.: 10/127,048

(22) Filed: Apr. 19, 2002

(51) Int. Cl.[7] ..... F42B 12/54
(52) U.S. Cl. ..... 102/512; 604/130; 604/137
(58) Field of Search ..... 102/512; 604/130–137, 604/191

(56) References Cited

U.S. PATENT DOCUMENTS

| | | | | |
|---|---|---|---|---|
| 979,993 A | | 12/1910 | O'byrne et al. | |
| 3,003,418 A | * | 10/1961 | Young | 102/436 |
| 3,420,220 A | | 1/1969 | Ferrando | 124/11 |
| 3,430,626 A | * | 3/1969 | Bergman | 604/137 |
| 3,494,358 A | * | 2/1970 | La Verne Fehlis et al. | 604/137 |
| 3,616,758 A | | 11/1971 | Komarov | 102/92 |
| 3,809,083 A | * | 5/1974 | Westergaard | 604/137 |
| 3,837,284 A | * | 9/1974 | Waldeisen | 102/512 |
| 3,948,263 A | | 4/1976 | Drake, Jr. et al. | 128/260 |
| 4,487,602 A | * | 12/1984 | Christensen et al. | 604/137 |
| 4,616,622 A | | 10/1986 | Milliman | 124/73 |
| 5,202,533 A | * | 4/1993 | Vandersteen | 102/512 |
| 5,333,594 A | | 8/1994 | Robinson | 124/73 |
| 5,868,699 A | | 2/1999 | Woodruff et al. | 604/49 |
| 5,961,494 A | * | 10/1999 | Hogan | 604/191 |
| 6,024,077 A | | 2/2000 | Kotsiopoulos | 124/71 |

* cited by examiner

*Primary Examiner*—Charles T. Jordan
*Assistant Examiner*—Tara M Golba

(57) ABSTRACT

An animal syringe system for injecting animals with a syringe using a delivery system that allows application at a distance away from the animal. The animal syringe system includes a drug-dispensing syringe inserted into an inner syringe sleeve correspondingly inserted into a two-sized compression spring inserted into an outer sleeve. This assembled drug-dispensing projectile is loaded into a velocity adjustable air rifle. The drug-dispensing projectile is fired at an animal with the syringe needle impaling the animal. A trip device is then triggered releasing tension springs on the plunger of the syringe which injects the drug dose into the animal. As the plunger reaches its endpoint it triggers a two-sized spring inside the outer sleeve which pushes the inner sleeve and syringe away from the animal and the front end of the outer sleeve. As the syringe needle retracts completely into the outer sleeve the drug-dispensing projectile falls harmlessly to the ground.

18 Claims, 11 Drawing Sheets

ANIMAL SYRINGE SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a drug-dispensing system for animals and more specifically it relates to an animal syringe system for injecting animals with a syringe using a delivery system that allows application at a distance away from the animal and for the automatic withdrawal of the syringe from the animal once drug delivery is complete.

2. Description of the Related Art

Drug-dispensing systems for animals have been in use for years. Typically, for the treatment of livestock, the livestock has to be corralled and then manipulated into a treatment chute where the animal is physically immobilized and then the drug is injected into the animal using a standard drug-delivery syringe. In the case of wild and/or dangerous animals, the animals are normally tranquilized using a tranquilization dart and once the animal is rendered harmless the drug is injected into the animal using a standard drug-delivery syringe.

This product could be used for the treatment of entire herds, but would be most beneficial for the treatment of just a few head of livestock in hard to treat places such as large feedlots, pastures, and other similar places. In an effort to administer treatment to just a couple animals in a pen with the prior art systems, the entire pen of animals may need to get chased around and the couple head needed to get treated would need to get segregated from the herd and restrained. It is in this process a tame animal can become tired and dangerous. With wild and/or dangerous animals the prior art is hampered by the inherent risks in tranquilizing animals. Too much tranquilizer can kill the animal, and not enough can be dangerous for the individual involved in attempting to administer drugs to the animal.

Examples of patented devices which are related to the present invention include U.S. Pat. No. 5,868,699 to Woodruff et al.; U.S. Pat. No. 6,024,077 to Kotsiopoulos; U.S. Pat. No. 5,333,594 to Robinson; U.S. Pat. No. 4,616,622 to Milliman; U.S. Pat. No. 3,948,263 to Drake, Jr. et al.; U.S. Pat. No. 3,616,758 to Komarov; U.S. Pat. No. 3,420,220 to Ferrando; and U.S. Pat. No. 979,993 to Obyrne et al.

While these devices may be suitable for the particular purpose to which they address, they are not as suitable for injecting animals with a syringe using a delivery system that allows application at a distance away from the animal and for the automatic withdrawal of the syringe from the animal once drug-delivery is complete. Current systems do not provide for delivering drugs to an animal in a quick, efficient and non-labor intensive method.

In these respects, the animal syringe system according to the present invention substantially departs from the conventional concepts and designs of the prior art, and in so doing provides an apparatus primarily developed for the purpose of injecting animals with a syringe using a delivery system that allows application at a distance away from the animal and for the automatic withdrawal of the syringe from the animal once drug-delivery is complete.

BRIEF SUMMARY OF THE INVENTION

In view of the foregoing disadvantages inherent in the known types of drug-dispensing systems for animals now present in the prior art, the present invention provides a new animal syringe system construction wherein the same can be utilized for injecting animals with a syringe using a delivery systems that allows application at a distance away from the animal and for the automatic withdrawal of the syringe from the animal once drug-delivery is complete.

The general purpose of the present invention, which will be described subsequently in greater detail, is to provide a new animal syringe system that has many of the advantages of the drug-dispensing systems for animals mentioned heretofore and many novel features that result in a new animal syringe system which is not anticipated, rendered obvious, suggested, or even implied by any of the prior art drug-dispensing system for animals, either alone or in any combination thereof.

To attain this, the present invention generally comprises a drug-dispensing syringe inserted into an inner syringe sleeve correspondingly inserted into a compression spring inserted into an outer sleeve. This assembled drug-dispensing projectile is loaded into a velocity adjustable air rifle. The drug dispensing projectile is fired at an animal with the syringe needle impaling the animal. A trip device is then triggered releasing tension springs on the plunger of the syringe which injects the drug dose into the animal. As the plunger reaches its endpoint it triggers a compression spring inside the outer sleeve which pushes the inner sleeve and syringe away from the animal and the front end of the outer sleeve. As the syringe needle retracts completely into the outer sleeve the drug-dispensing projectile falls harmlessly to the ground.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide an animal syringe system that will overcome the shortcomings of the prior art devices.

A second object is to provide an animal syringe system for injecting animals with a syringe using a delivery system that allows application at a distance away from the animal.

Another object is to provide an animal syringe system that allows for visually marking the animals that have been treated.

An additional object is to provide an animal syringe system that is easy to operate.

A further object is to provide an animal syringe system that creates less stress on the animal by eliminating the need to catch and physically restrain the animal.

An additional object is to provide an animal syringe system that is not labor intensive.

Another object is to provide an animal syringe system that prevents accidental tranquilizer overdosing of an animal.

Another object is to provide an animal syringe system that allows the treating of animals by a single individual.

A further object is to provide an animal syringe system that allows for the insertion of variable doses of drug.

An additional object is to provide an animal syringe system that provides for firing at adjustable velocity rates.

Another object is to provide an animal syringe system that allows for easy retrival and reuse.

Another object is to provide an animal syringe system that allows for easy refilling of the propulsion source.

A further object is to provide an animal syringe system that allows for its operation from within a vehicle or behind a protective structure.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
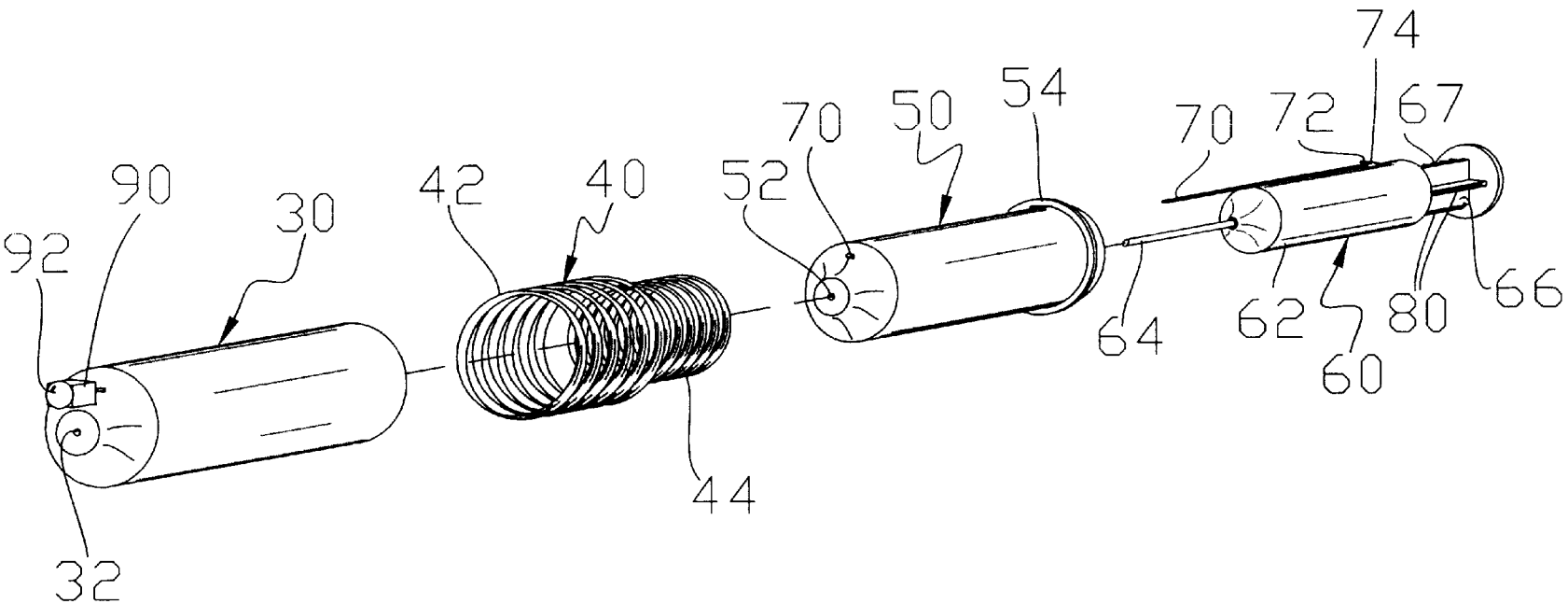
FIG. 1 is an exploded upper perspective view of the present invention.

Turning now descriptively to the drawings, in which similar reference characters denote similar elements throughout the several views, FIGS. 1 through 11 illustrate an animal syringe system 10, which comprises a drug-dispensing syringe 60 inserted into an inner syringe sleeve 50 correspondingly inserted into a compression spring 40 inserted into an outer sleeve 30. This assembled drug-dispensing projectile 16 is loaded into a velocity adjustable air gun 20. The drug dispensing projectile 16 is fired at an animal with the syringe needle 64 impaling the animal. A trip device 70 is then triggered releasing tension springs 80 on the plunger 66 of the syringe 60 which injects the drug dose into the animal. As the plunger 66 reaches its endpoint it triggers the compression spring 40 inside the outer sleeve 30 which pushes the inner sleeve 50 and syringe 60 away from the animal and the outer sleeve 30. As the syringe needle 64 retracts completely into the outer sleeve 30 the drug-dispensing projectile 16 falls to the ground.

Figure 2:
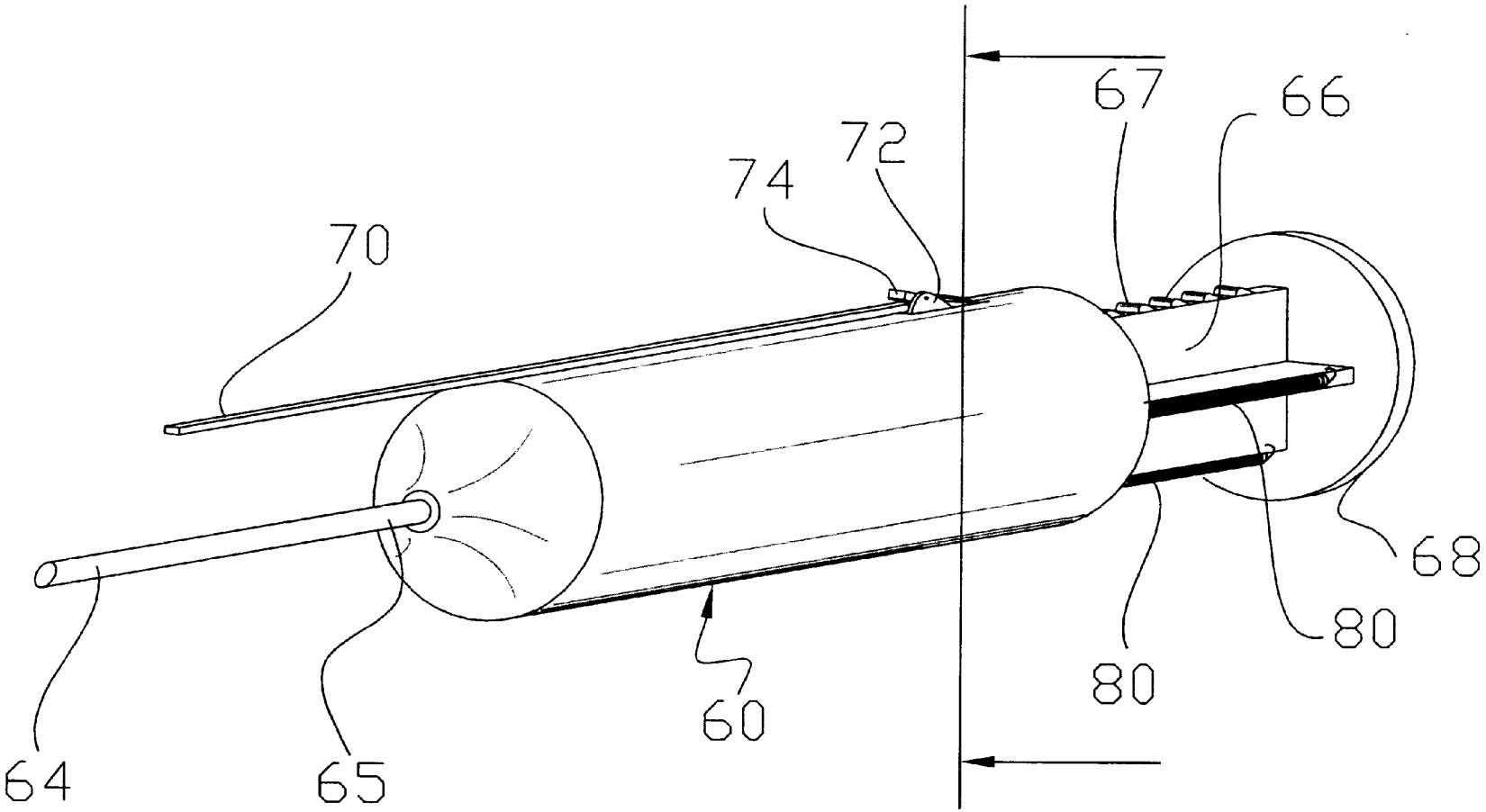
FIG. 2 is a perspective view of the syringe.
Figure 3:
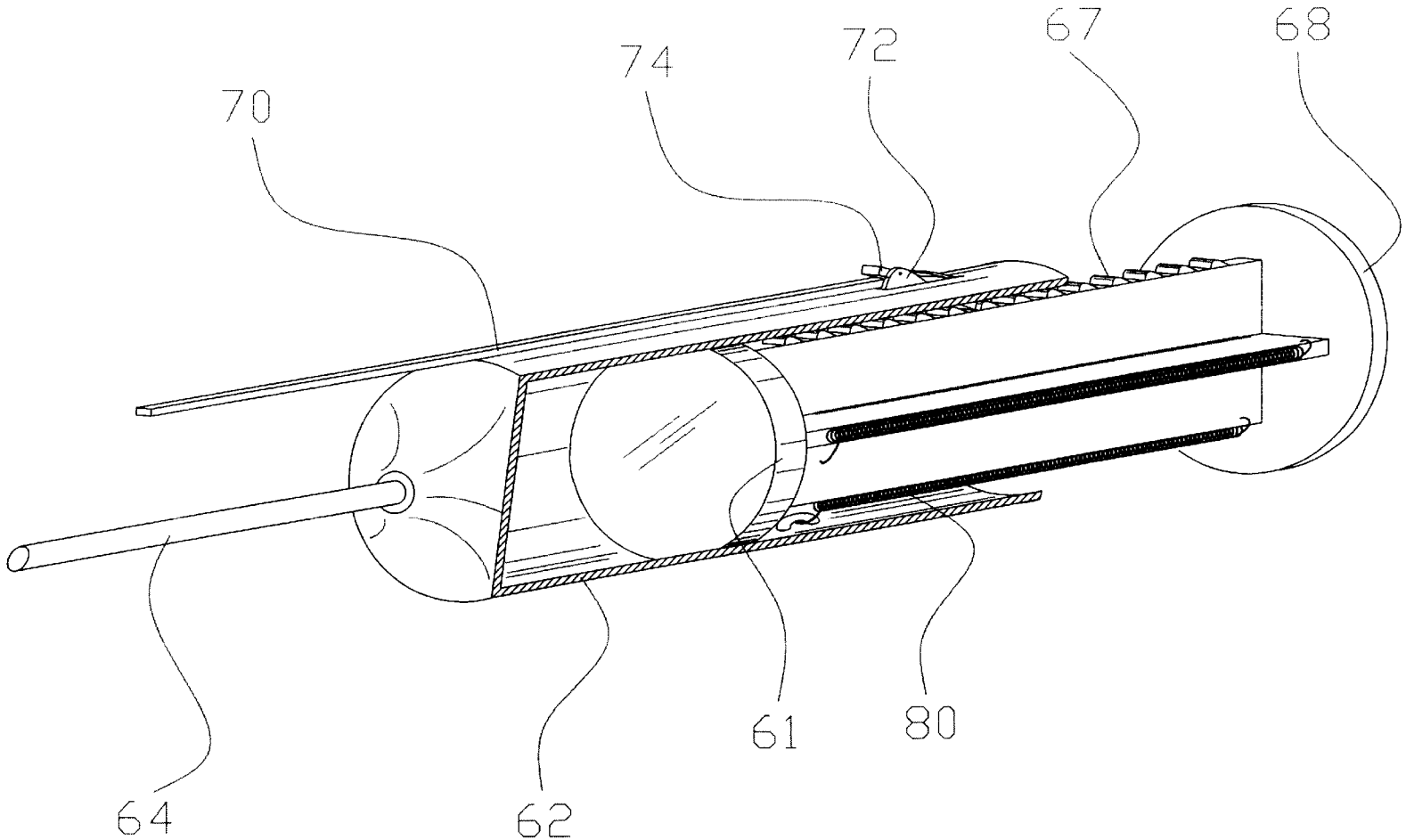
FIG. 3 is a cutaway view of the syringe.

As best illustrated in FIGS. 2 and 3, the syringe is preferably comprised of a hollow, translucent tube 62 with a first end which is sealed except for a small opening 65 capable of having affixed thereto a disposable needle 64. The hollow tube 62 preferably has graduated markings corresponding to varying doses of drugs. Insertable into the second end of the hollow tube 62 is a plunger 66 having an insertion end, a mid-section and a trailing end. At the insertion end of the plunger 66 is an elastic piston 63 capable of maintaining liquids inside the hollow tube 62. As best seen in FIG. 3, the plunger 66 mid section may be manufactured from plastic and X shaped along the length of the mid-section. Along one portion of the X shaped mid-section are a plurality of raised notches 67. The trailing end of the plunger has a circular shaped stopper 68 that is preferably concaved. Attached to the three remaining ribs of the X shaped mid-section near the trailing end of the plunger 66 are tension springs 80. The tension springs 80 are correspondingly attached to the inner wall of the hollow tube 62. However, it can be appreciated by one skilled in the art that other embodiments of the present invention may include the plurality of raised notches 67 and tension springs in other locations upon the plunger 66.

Figure 10:
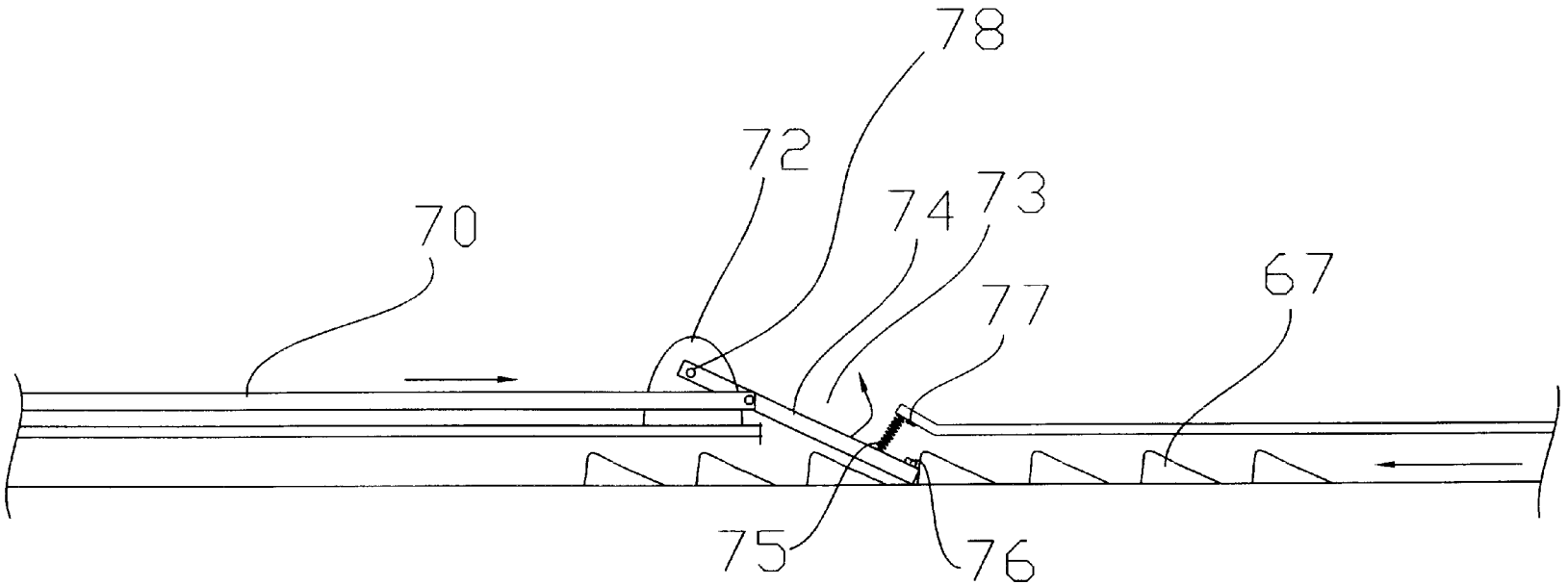
FIG. 10 is a magnified side view of the pressure rod engaging the latch.

As seen in FIG. 10, there is an aperture 73 on the side of the hollow tube 62. Located forward of the aperture 73, toward the first end of the hollow tube 62, is a pivot point assembly 72. Pivotally attached to the pivot point assembly 72 is a latch 74 which traverses through the aperture 73 and rests upon the plunger 66. Affixed to the latch 74 opposite the pivotally attached end of the latch 74 is a magnet 76. Attached to the inner wall of the hollow tube 62, directly opposite the magnet 76 is an opposite polarity magnet 77. A latch compression spring 75 is attached to the latch 74 above the magnet 76 and the inner wall of the hollow tube 62. Pivotally attached to the latch 74 between the pivot point 78 and the magnet 76 is a pressure push rod 70. However, it can be appreciated by one skilled in the art that other embodiments of the present invention may include other variations for triggering the release of a measured dose of drug from the syringe 60.

Figure 4:
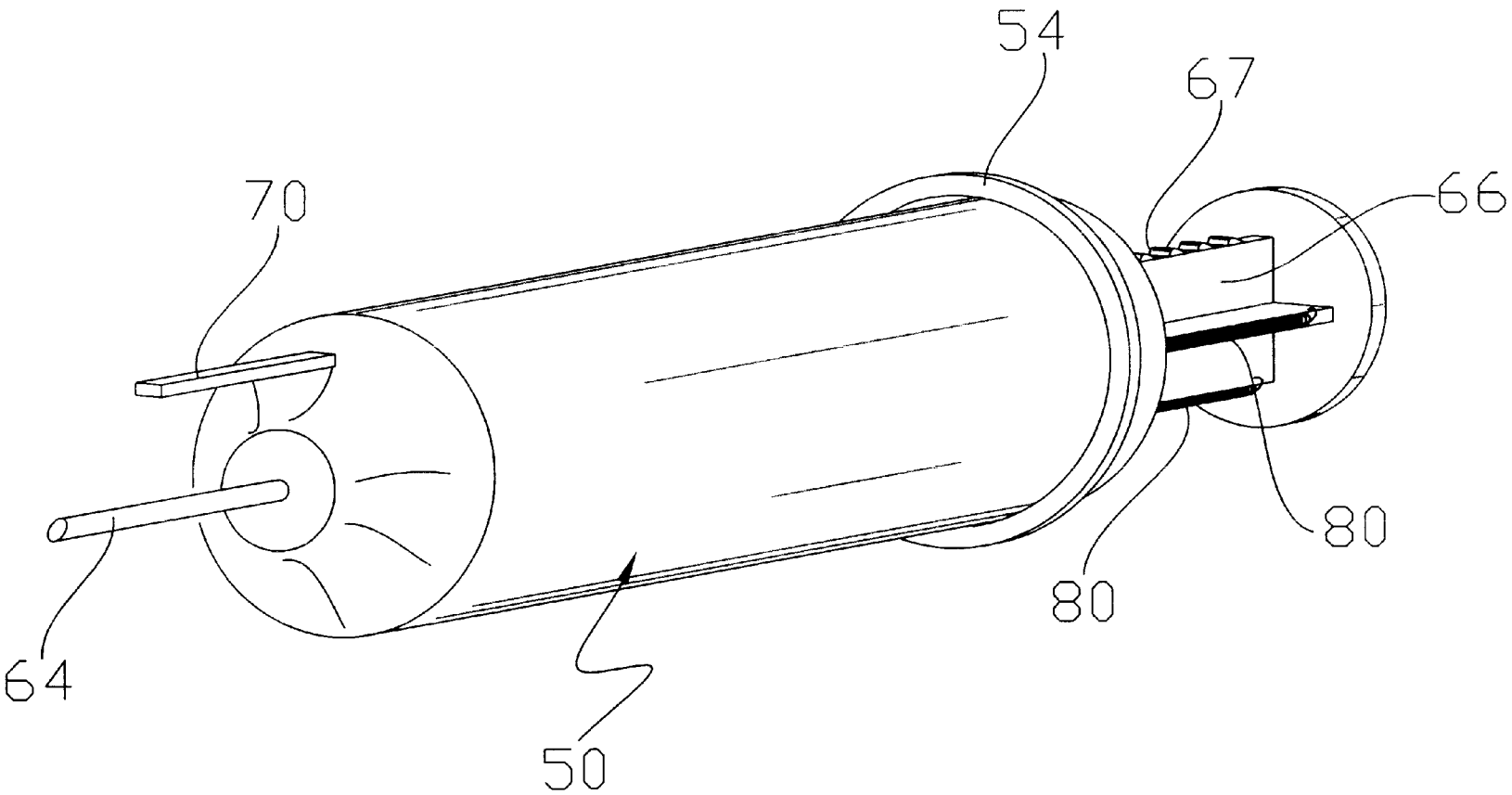
FIG. 4 is a perspective view of the inner sleeve surrounding the syringe.

As seen in FIGS. 1 and 4 the inner sleeve 50 is a hollow tube of an interior dimension to allow the insertion of the syringe 60. The inner sleeve 50 has a first end and a second end. The first end includes an opening 52 at a diameter to allow the insertion of the syringe needle 64. Additionally, the front end has an opening 58 in the shape of the cross-section of the pressure push rod 70. This opening 58 aligns with the pressure push rod 70 when the syringe 60 is inserted into the inner-sleeve 50. Near the second end of the inner sleeve 50 attached circumferencely around the exterior wall is a spring stop ring 54 Located between the spring stop ring 54 and the second end, attached to the exterior side of the inner sleeve 50, is a U-shaped notch 56.

Figure 5:
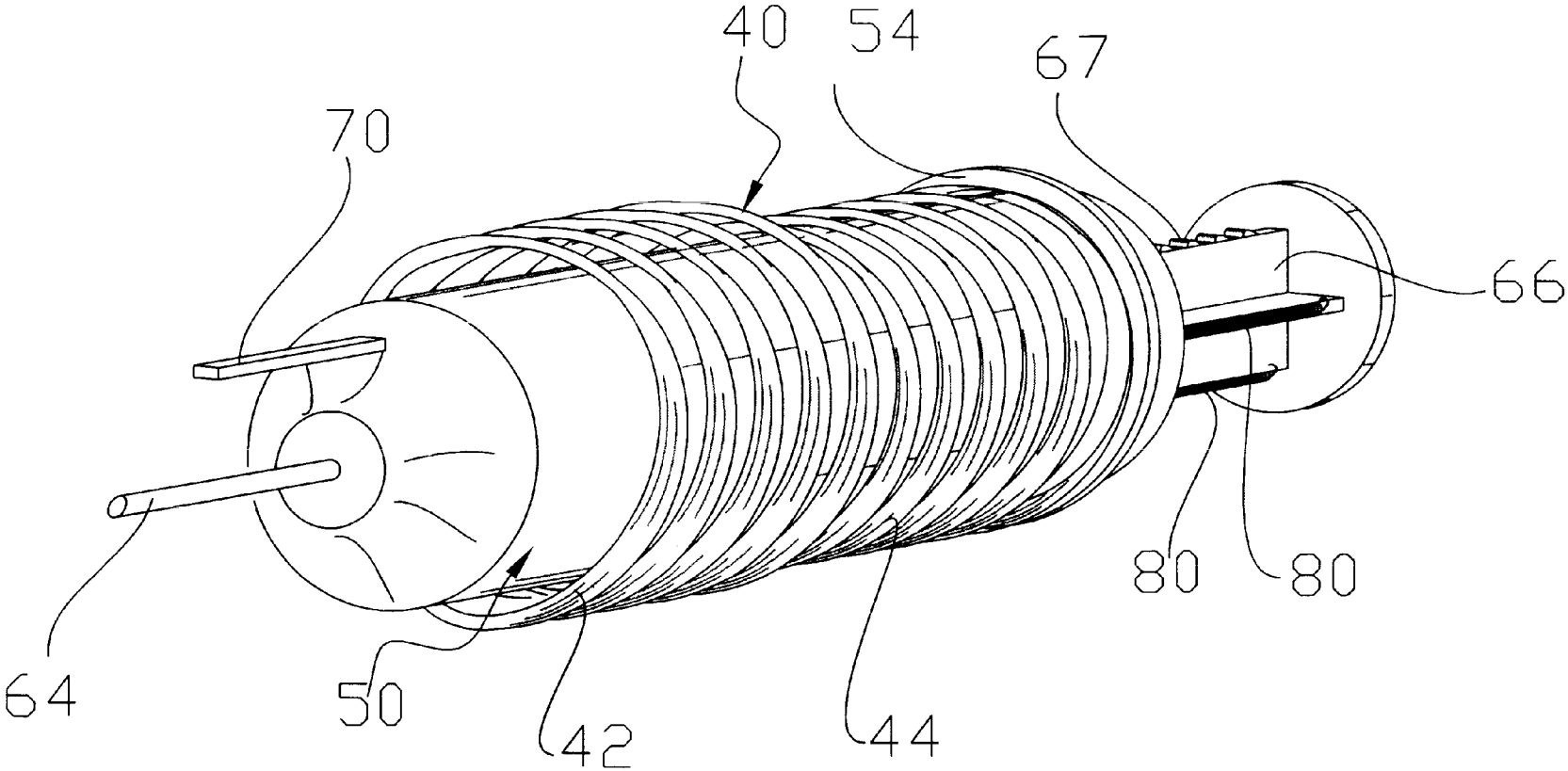
FIG. 5 is a perspective view of the inner sleeve surrounded by the compression spring.

As best seen in FIG. 5, the next component in the drug-delivery projectile 16 is compression spring 40 having two sections. The smaller section 44 of the compression spring 40 is sized to fit around the outer circumference of the inner sleeve 50. The larger section 42 of the compression spring 40 is sized to fit within the inner circumference of the outer sleeve 30.

The outer sleeve 30 is a hollow tube having a first end, that is sealed except for two openings 32 and 34, and a second end. As seen in FIG. 1, the outer sleeve 30 has an interior dimension to allow the insertion of the compression spring 40 and inner sleeve 50. The first end includes an opening 32 at a diameter to allow the insertion of the syringe needle 64. Additionally, the first end has a second opening 34 in the shape of the cross-section of the pressure push rod 70. This opening 34 aligns with the pressure push rod 70 when the syringe 60 and inner sleeve 50 is inserted into the outer sleeve 30. At the first end, hingedly affixed between the opening 34 for the pressure push rod 70 and the opening 32 for the syringe needle 64, is a pressure push rod 70 triggering mechanism 90. The pressure push rod triggering mechanism 90 is preferably designed to hold a commercially available paint ball 92.

Located at the approximate mid-point of the interior wall of the outer sleeve 30 is a larger section compression spring stop 46. Located on the interior wall near the second end of the outer sleeve 30 is a triggering device 14. A pressure push rod 12 is attached off-center of the pivot point 18 of the triggering device 14.

The animal syringe system 10 air gun 20 has a barrel 22 having a breech end and a muzzle end. The diameter of the barrel 22 is sized for discharging the drug-dispensing projectile 16. The air gun 20 breaks down at the breech end of the barrel 22 to allow insertion of the drug-dispensing projectile 16. The stock 25 of the air gun 20 includes a refillable air canister 24. At the butt-end of the stock 25 is an adjustable threaded bolt 26. The opposing end of the bolt 26 is attached to a plate 28 which is in contact with the air canister 24. The trigger 23 on the air gun 20 is designed to release a volume of pressurized air from the air compression chamber 27 against the stopper 68 of the drug-dispensing projectile 16. The trigger 23 is also attached to a release lever 25 which holds the drug-dispensing projectile 16 in place in the breech end of the barrel 22. Located between the air canister 24 and the air compression chamber 27 is a pressure gauge 29 to adjust the volume of air from the air canister 24 to the air compression chamber 27.

In use, the syringe plunger 66 is drawn back in the hollow tube 62 to load the required drug fluidly through the disposable syringe needle 64. Once the plunger 66 is drawn back to the corresponding dose, the pivot point assembly latch 74 is placed into the corresponding notch 67 on the plunger 66 as best seen in FIG. 10. As illustrated in FIG. 4, the syringe 60 is then inserted into the inner sleeve 50. The disposable syringe needle 64 is inserted through the corresponding inner sleeve 50 syringe, needle opening 52. The pressure push rod 70 is inserted through the corresponding pressure push rod opening 58 in the inner sleeve 50. The compression spring 40 is then placed over the inner sleeve 50 as illustrated in FIG. 5. The inner sleeve 50 with compression spring 40 is then inserted into the outer sleeve 30 lining up the pressure push rod 70 with its corresponding opening 34 in the outer sleeve 30 and lining up the disposable syringe needle 64 with its corresponding opening 32 in the outer sleeve 30. To insert the inner sleeve 50 into the outer sleeve 30 the larger section 42 of the compression spring 40 is forced past the larger section compression spring stop 46. The compression spring 40 is compressed by applying force to the smaller section 44 of the compression spring 40 using the spring stop ring 54. The inner sleeve 50 is pushed into the outer sleeve 30 until the triggering device 14 inserts into the U-shaped notch 56 at the second end of the inner sleeve 50. If desired, a commercially available paint ball 92 is attached to the pressure push rod triggering mechanism 90.

Figure 6:
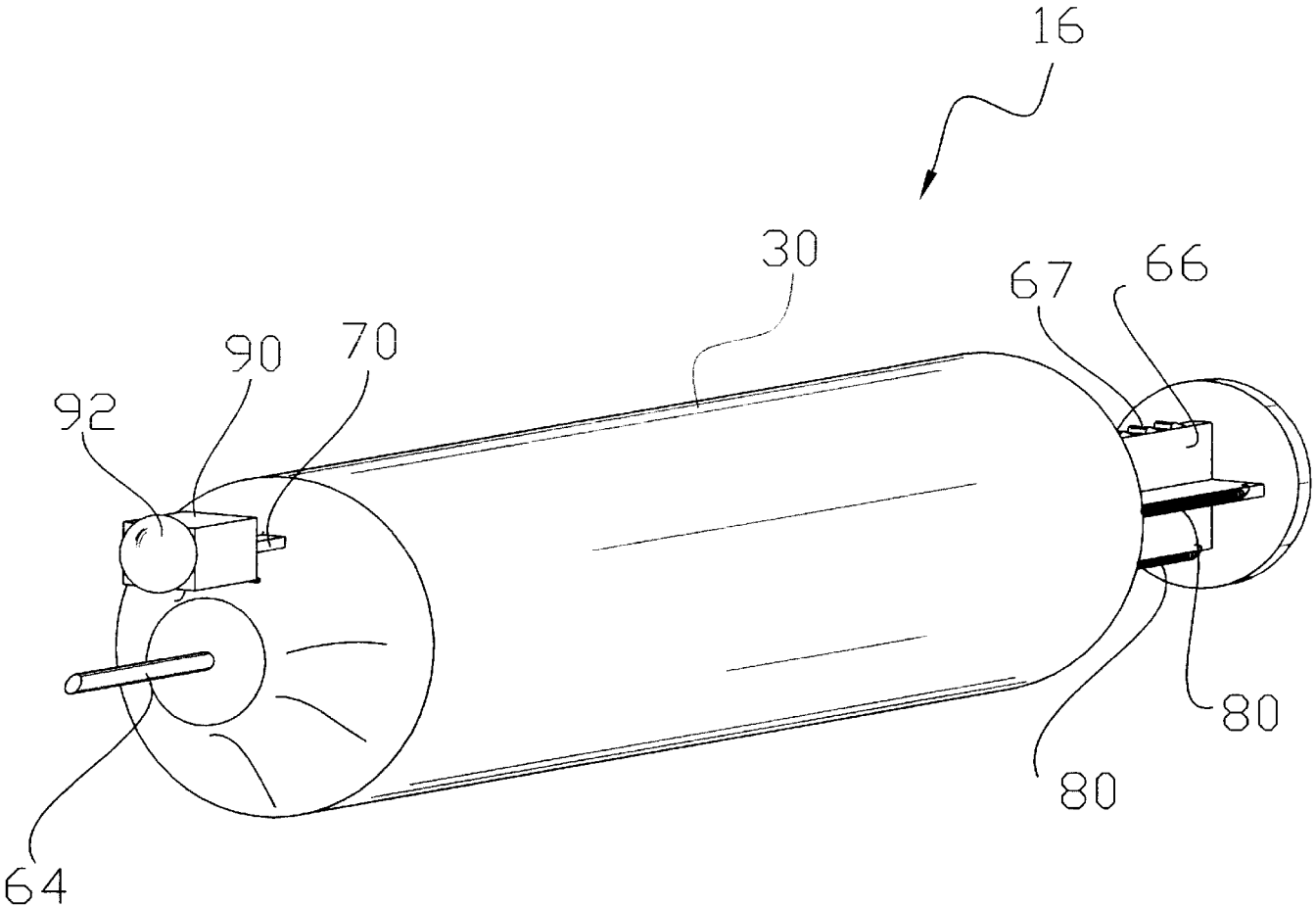
FIG. 6 is a perspective view of the outer sleeve surrounding the syringe and inner sleeve.
Figure 7:
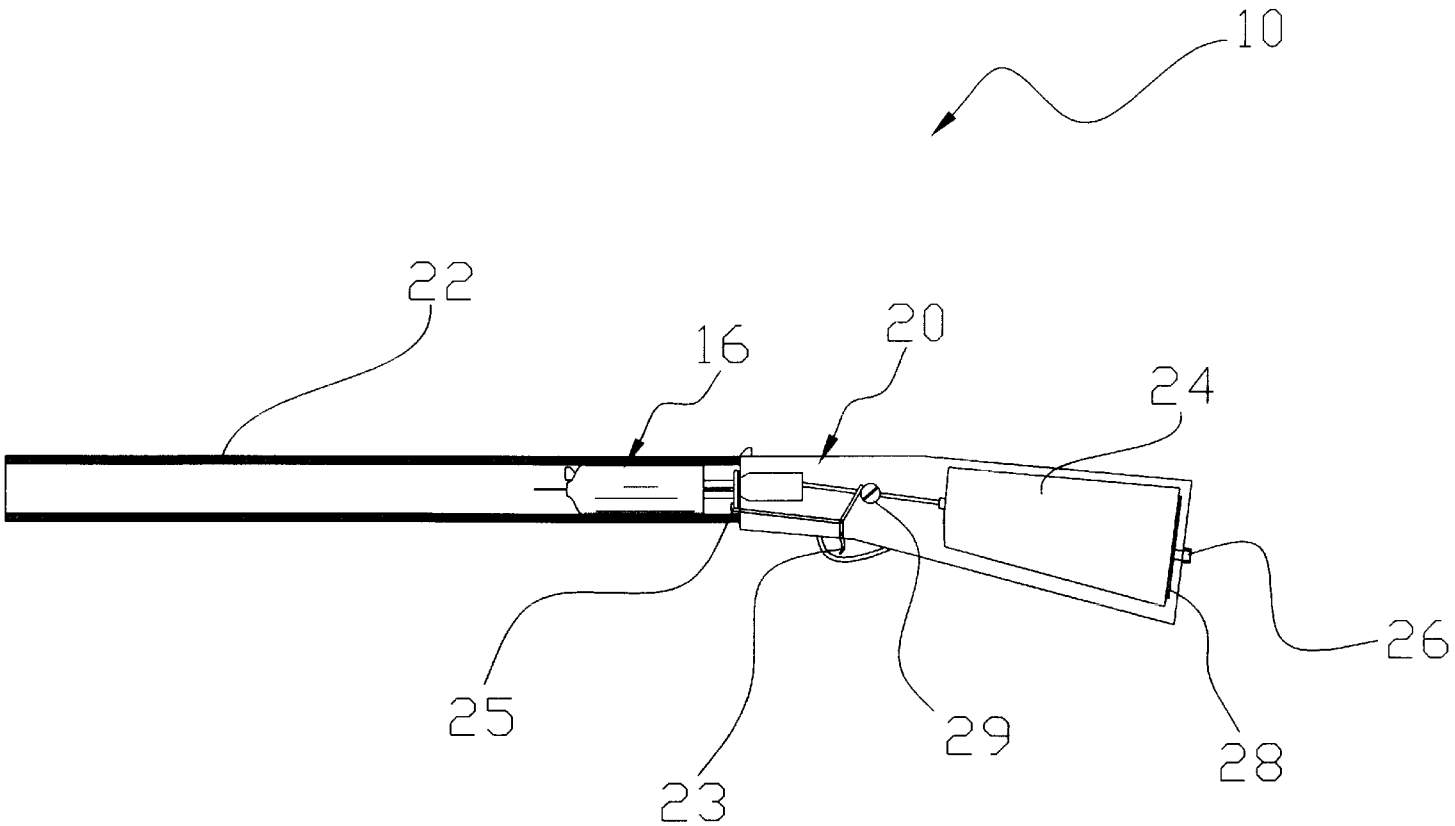
FIG. 7 is a side cutaway view of the present invention positioned within an air gun.

The air gun 20 is broken open at the breech end of the barrel 22 and the assembled drug-dispensing projectile 16, as illustrated in FIG. 6, is inserted into the breech end of the barrel 22 with the disposable syringe needle 64 pointed towards the muzzle end of the barrel 22. The trigger latch 25 is placed over the syringe plunger end 68 and the barrel 22 is locked back into position to discharge the drug-dispensing projectile 16. The threaded bolt 26 is screwed clockwise forcing the plate 28 against the air canister 24 aligning it into position releasing a volume of air into the air compression chamber 27. As best seen in FIG. 7, the animal syringe system is ready to fire.

Figure 8:
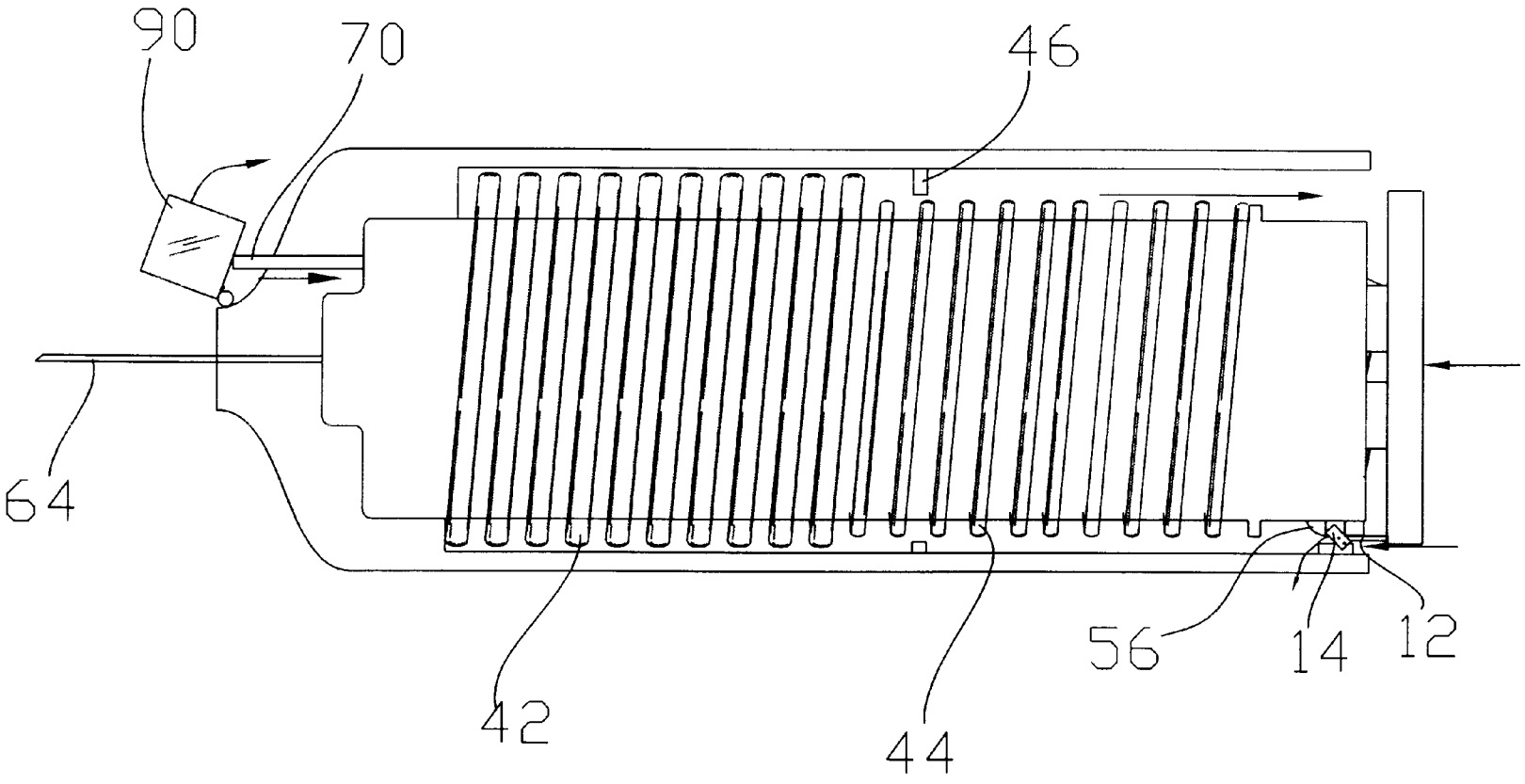
FIG. 8 is a side cutaway view of the paint ball holder engaging the pressure rod after impacting an animal.
Figure 9:
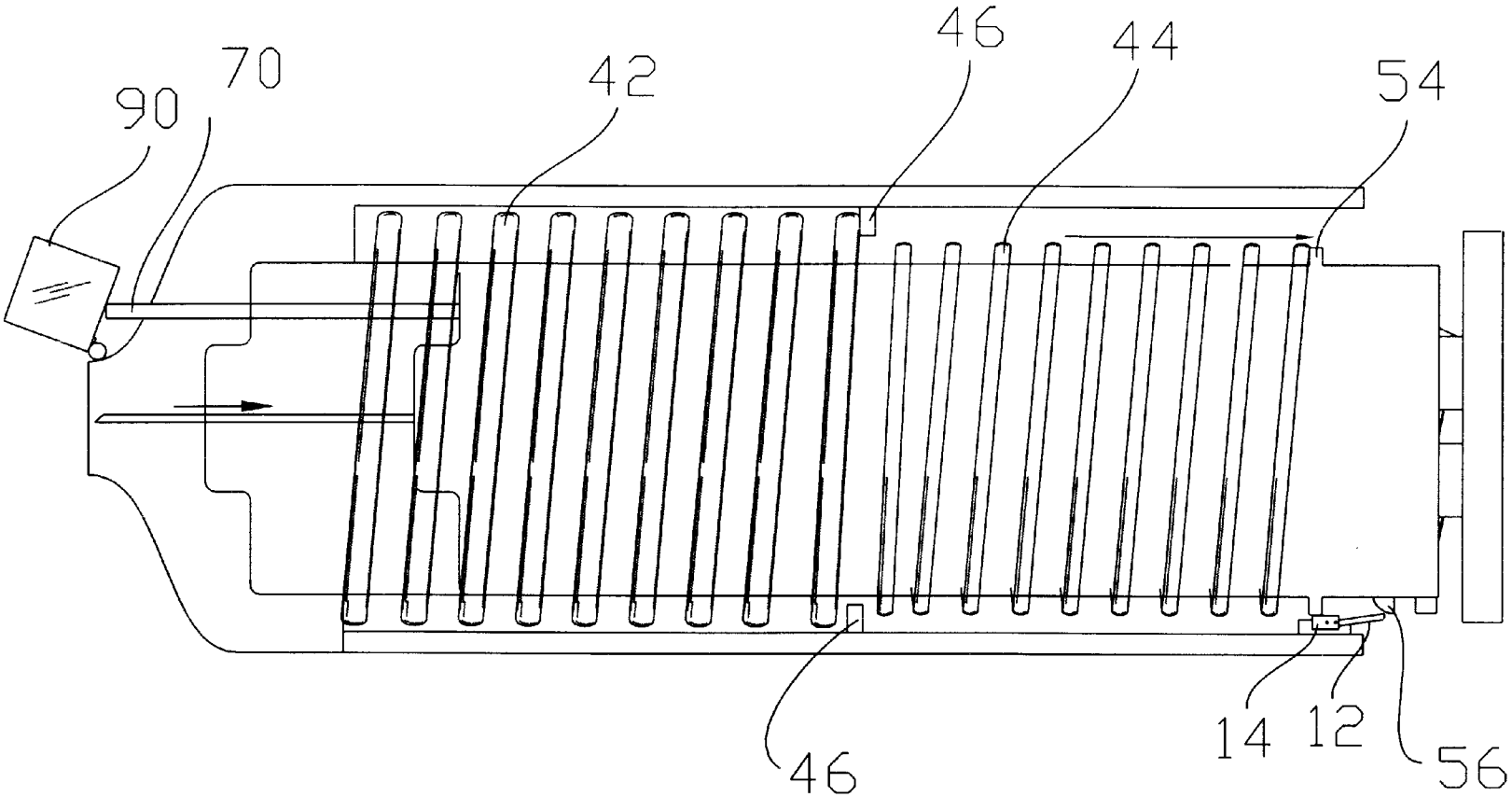
FIG. 9 is a side cutaway view of the present invention with the inner sleeve and syringe drawn into the outer sleeve after the composition has been dispensed through the needle to the animal.
Figure 11:
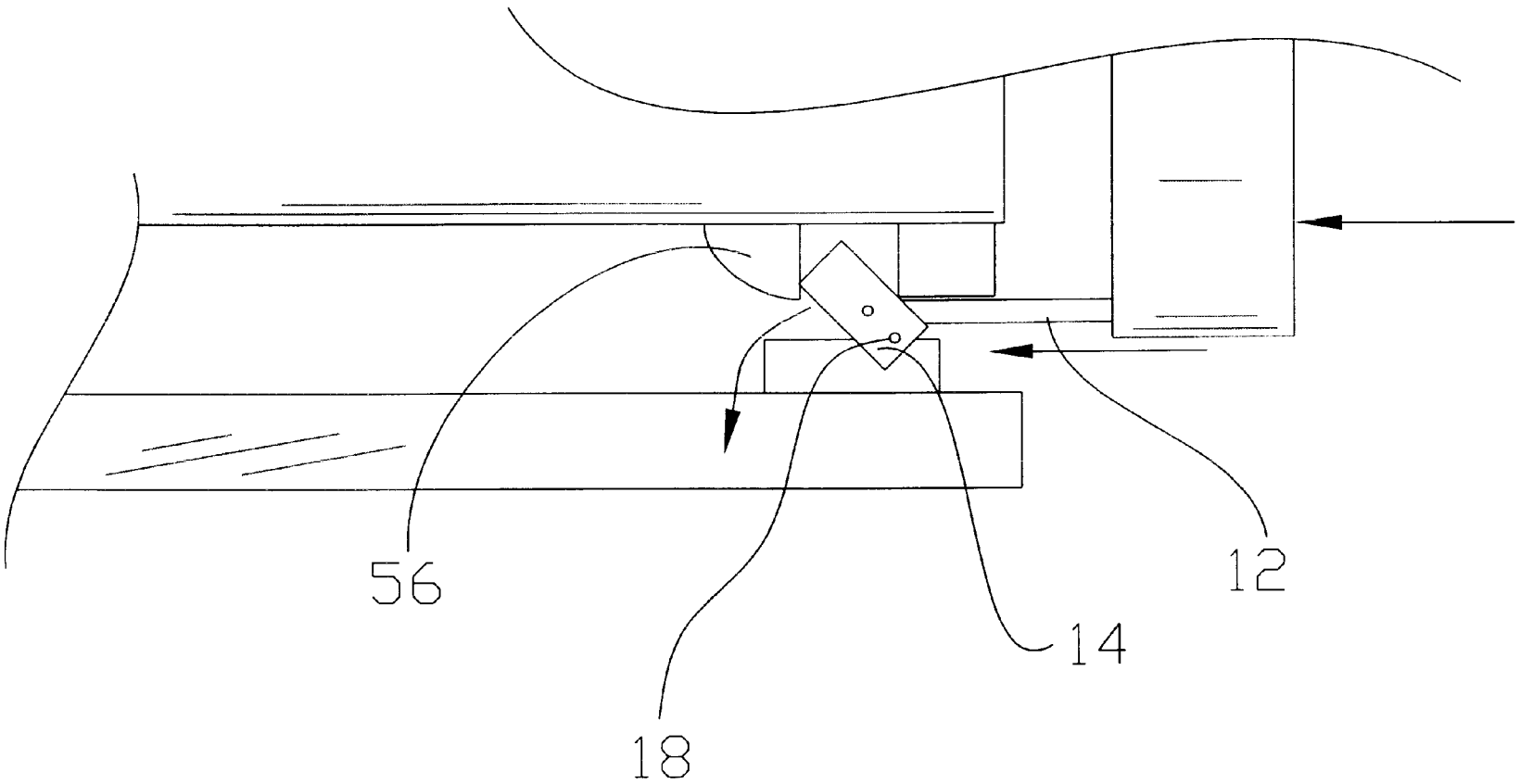
FIG. 11 is a magnified view of the triggering device claims.

The animal syringe system 10 is pointed at the animal and the trigger 22 is depressed. Depressing the trigger 22 releases the drug-dispensing projectile 16 and allows the air compression chamber 27 to release a pressurized charge of air. The drug-dispensing projectile 16 is dispensed from the air gun 20 at a relatively high velocity and engages the animal. Upon contact with the animal, the syringe needle 64 penetrates the skin and the paint ball 92 impacts the target thereby marking the animal. As shown in FIG. 10 of the drawings, the pressure push rod 70 engages the animal simultaneously with the needle 64 and is forced rearwardly towards the pivot joint assembly 72 pushing the latch 74 away from the corresponding notch 76 and compressing the latch spring 75. The magnets 76 and 77 attract and attach to one another holding the latch 74 away from the notches 76 as best shown in FIG. 10 of the drawings. As the plunger 66 is released from the latch 74, the tension springs 80 compress pulling the plunger 66 inwardly towards the syringe needle 64 as shown in FIG. 3 of the drawings. As seen in FIG. 11, as the plunger 66 comes towards the syringe needle 64 dispensing the remaining volume of drug within and the stopper 68 impacts the pressure push rod 12. The pressure, push rod 12 forces the triggering device 14 out of the notch 56. Once the triggering device 14 is forced out of the notch 56 thereby releasing the inner sleeve 50, the compression spring 40 expands pushing the inner sleeve 50 outwardly away from the outer sleeve 30 as shown in FIG. 8 of the drawings. As the syringe needle 64 is drawn into the outer sleeve 30, the larger section 42 of the compression spring 40 catches on the larger section compression spring stop 46 as shown in FIG. 9 of the drawings. Once the syringe needle 64 is drawn completely away from the animal and into the outer sleeve 30, the spent drug-delivery projectile 16 falls to the ground where it may be retrieved.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

I claim:

1. An animal syringe system, comprising:

a syringe having a plunger slidably positioned within and at least one tension spring attached to said plunger for drawing said plunger inwardly;

a first catch mechanism within said syringe for selectively engaging said plunger;

an inner sleeve slidably receiving said syringe;

an outer sleeve movably positioned about said inner sleeve, wherein said outer sleeve has a front end with a needle opening for allowing a needle from said syringe to extend through;

a compression spring positioned about said inner sleeve and within said outer sleeve, wherein said compression spring is compressed between an inner end of said outer sleeve and an outer flange of said inner sleeve;

a pressure rod slidably extending through said front end of said outer sleeve and said inner sleeve to adjacent said first catch mechanism, wherein said pressure rod releases said first catch mechanism upon engaging an object; and a second catch mechanism connected between said outer sleeve and said inner sleeve, wherein said second catch mechanism is released when said plunger is fully drawn inwardly.

2. The animal syringe system of claim 1, wherein said compression spring is comprised of a first section and a second section, wherein said first section has a larger diameter than said second section, and, a first spring stop is positioned within an interior portion of said outer sleeve for engaging said first section between said first section and said second section.

3. The animal syringe system of claim 2, wherein said inner sleeve includes a second spring stop for engaging a distal end of said second section of said compression spring.

4. The animal syringe system of claim 1, wherein said first catch mechanism is comprised of:

a plurality of raised notches within said plunger; and a latch pivotally attached to said syringe and connected to said pressure rod, wherein said latch engages one of said raised notches in the engaged position.

5. The animal syringe system of claim 4, wherein said pressure rod is connected between a pivot point of said latch and a distal end of said latch.

6. The animal syringe system of claim 1, wherein said second catch mechanism is comprised of:

a notch within said inner sleeve;

a triggering device pivotally attached to an inner surface of said outer sleeve with a distal portion engaged within said notch in the engaged position; and a push rod attached to said triggering device extending rearwardly to be engaged by said plunger when said plunger is fully drawn inwardly within said syringe thereby releasing said triggering device from said notch.

7. The animal syringe system of claim 1, wherein said inner sleeve includes a front closed end with a needle insertion opening for receiving said needle.

8. The animal syringe system of claim 1, wherein said inner sleeve snugly receives said syringe within.

9. The animal syringe system of claim 1, wherein said first catch mechanism is comprised of:

a plurality of raised notches within said plunger, wherein said plurality of raised notches have a saw tooth structure angled rearwardly; and a latch pivotally attached to said syringe and connected to said pressure rod, wherein said latch engages one of said raised notches in the engaged position.

10. An animal syringe system, comprising:

a syringe having a plunger slidably positioned within and at least one tension spring attached to said plunger for drawing said plunger inwardly;

a first catch mechanism within, said syringe for selectively engaging said plunger;

an inner sleeve slidably receiving said syringe;

an outer sleeve movably positioned about said inner sleeve, wherein said outer sleeve has a front end with a needle opening for allowing a needle from said syringe to extend through;

a compression spring positioned about said inner sleeve and within said outer sleeve, wherein said compression spring is compressed between an inner end of said outer sleeve and an outer flange of said inner sleeve;

a pressure rod slidably extending through said front end of said outer sleeve and said inner sleeve to adjacent said first catch mechanism, wherein said pressure rod releases said first catch mechanism upon engaging an object;

a paint ball mechanism attached to said front end of said outer sleeve for marking an animal upon impact;

a second catch mechanism connected between said outer sleeve and said inner sleeve, wherein said second catch mechanism is released when said plunger is fully drawn inwardly.

11. The animal syringe system of claim 10, wherein said compression spring is comprised of a first section and a second section, wherein said first section has a larger diameter than said second section, and a first spring stop is positioned within an interior portion of said outer sleeve for engaging said first section between said first section and said second section.

12. The animal syringe system of claim 11, wherein said inner sleeve includes a second spring stop for engaging a distal end of said second section of said compression spring.

13. The animal syringe system of claim 10, wherein said first catch mechanism is comprised of:

a plurality of raised notches within said plunger; and a latch pivotally attached to said syringe and connected to said pressure rod, wherein said latch engages one of said raised notches in the engaged position.

14. The animal syringe system of claim 13, wherein said pressure rod is connected between a pivot point of said latch and a distal end of said latch.

15. The animal syringe system of claim 10, wherein said second catch mechanism is comprised of:

a notch within said inner sleeve;

a triggering device pivotally attached to an inner surface of said outer sleeve with a distal portion engaged within said notch in the engaged position; and a push rod attached to said triggering device extending rearwardly to be engaged by said plunger when said plunger is fully drawn syringe thereby releasing said triggering device from said notch.

16. The animal syringe system of claim 10, wherein said inner sleeve includes a front closed end with a needle insertion opening for receiving said needle.

17. The animal syringe system of claim 10, wherein said inner sleeve snugly receives said syringe within.

18. The animal syringe system of claim 10, wherein said paint ball mechanism is comprised of a paint ball holder pivotally attached to said front end of said outer sleeve and adjacent to an end of said pressure rod, and a paint ball within said paint ball mechanism, wherein said paint ball holder pivots inwardly upon impact with an animal thereby pushing said pressure rod rearwardly to engage said first catch mechanism.

* * * * *